United States Patent [19]

Ofusa

[11] Patent Number: 4,498,503

[45] Date of Patent: Feb. 12, 1985

[54] METHOD AND APPARATUS FOR MANUFACTURING WOVEN SLIDE FASTENER STRINGERS

[75] Inventor: Masaatsu Ofusa, Kurobe, Japan

[73] Assignee: Yoshida Kogyo K. K., Tokyo, Japan

[21] Appl. No.: 441,397

[22] Filed: Nov. 12, 1982

[30] Foreign Application Priority Data

Nov. 19, 1981 [JP] Japan ..... 56-185658
Dec. 29, 1981 [JP] Japan ..... 56-197188[U]

[51] Int. Cl.[3] ..... D03D 49/50; D03D 47/00; A44B 19/42

[52] U.S. Cl. ..... 139/116; 139/11; 139/384 B; 24/392

[58] Field of Search ..... 139/116, 117, 118, 11, 139/384 B, 431; 24/391, 392, 393

[56] References Cited

U.S. PATENT DOCUMENTS 3,692,068 9/1972 Auer et al. ..... 139/116

FOREIGN PATENT DOCUMENTS 1167578 4/1964 Fed. Rep. of Germany ... 139/384 B
2221855 11/1972 Fed. Rep. of Germany .
50-36249 4/1975 Japan .
342539 1/1960 Switzerland ..... 139/11

*Primary Examiner*—James Kee Chi
*Attorney, Agent, or Firm*—Hill, Van Santen, Steadman & Simpson

[57] ABSTRACT

A method and apparatus for manufacturing a woven slide fastener stringer having a row of coupling elements woven integrally into a woven stringer tape as the latter is woven. An element-forming filamentary material is displaced away from warp threads of the stringer tape and is coiled by and around a hook which moves remotely from the warp threads without interference therewith. A woven slide fastener stringer produced by the method and apparatus has a row of coupling elements stably fixed in position to a stringer tape by a binding warp thread system having a pattern similar to a row of sewing stitches.

8 Claims, 9 Drawing Figures

METHOD AND APPARATUS FOR MANUFACTURING WOVEN SLIDE FASTENER STRINGERS

BACKGROUND OF THE INVENTION

1. Field of the Invention

The present invention relates to a method of and an apparatus for manufacturing a woven slide fastener stringer having a row of continuous filamentary coupling elements woven integrally into a stringer tape.

2. Prior Art

Various methods and apparatus for manufacturing woven slide fastener stringers have been proposed and used. An apparatus disclosed in Japanese Laid-Open Patent Publication No. 50-36,249 published Apr. 5, 1975 has a rotor for coiling an element-forming filamentary material of synthetic resin in a conical orbital path around a mandrel into a row of coupling elements as they are woven into a stringer tape in synchronism with the weaving of the latter. The known apparatus is complex in construction and hence needs tedious and time-consuming adjustment and maintenance.

According to another known apparatus shown in West German Laid-Open Patent Publication No. 2,221,885 published Nov. 30, 1972, an element-forming filamentary material is coiled into a row of coupling elements without using a rotor and a mandrel, the coupling elements being woven into a stringer tape as the latter is woven. The apparatus includes a rocker arm angularly movable in a plane substantially parallel to the general plane of the stringer tape for moving a hook into and out of a warp shed across warp threads to coil the element-forming filamentary material around the hook. The hook thus arranged is likely to interfere or otherwise damage the warp threads, particularly when the apparatus operates at a relatively high speed. A small-sized hook may reduce damage to the warp threads but is apt to fail to catch the element-forming filamentary material.

SUMMARY OF THE INVENTION

An element-forming filamentary material of synthetic resin, supplied to a fell of a stringer tape being woven along a longitudinal path extending between and substantially parallel to warp threads of the stringer tape, is displaced by an angularly movable pusher arm out of the longitudinal path into a position outside the warp threads. A hook angularly moves alongside the warp threads to hook the element-forming filamentary material at said position and to bring the same into another position adjacent to and aligned with the fell, thereby coiling the filamentary material around a rectangular nose portion of the hook into a coupling element.

It is an object of the present invention to provide a method of manufacturing a woven slide fastener stringer having a row of continuous filamentary coupling elements woven into a stringer tape at an increased rate of production without causing warp threads to become damaged.

Another object of the present invention is to provide an apparatus reducing such method to practice, which apparatus is simple in construction and easy to maintain.

Many other advantages, features and additional objects of the present invention will become manifest to those versed in the art upon making reference to the detailed description and the accompaying drawings in which certain preferred embodiments incorporating the principles of the present invention are shown by way of illustrative example.

DETAILED DESCRIPTION

Figure 1:
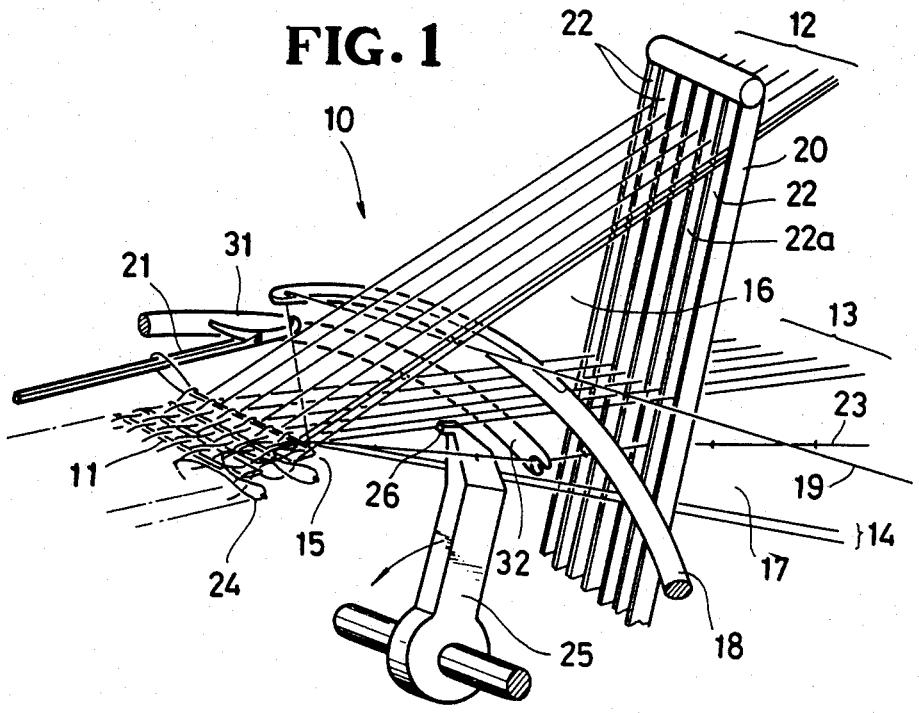
FIGS. 1 and 2 are schematic perspective views of an apparatus according to the present invention, the views showing parts in different positions while the apparatus is in operation to produce a woven slide fastener stringer.
Figure 2:
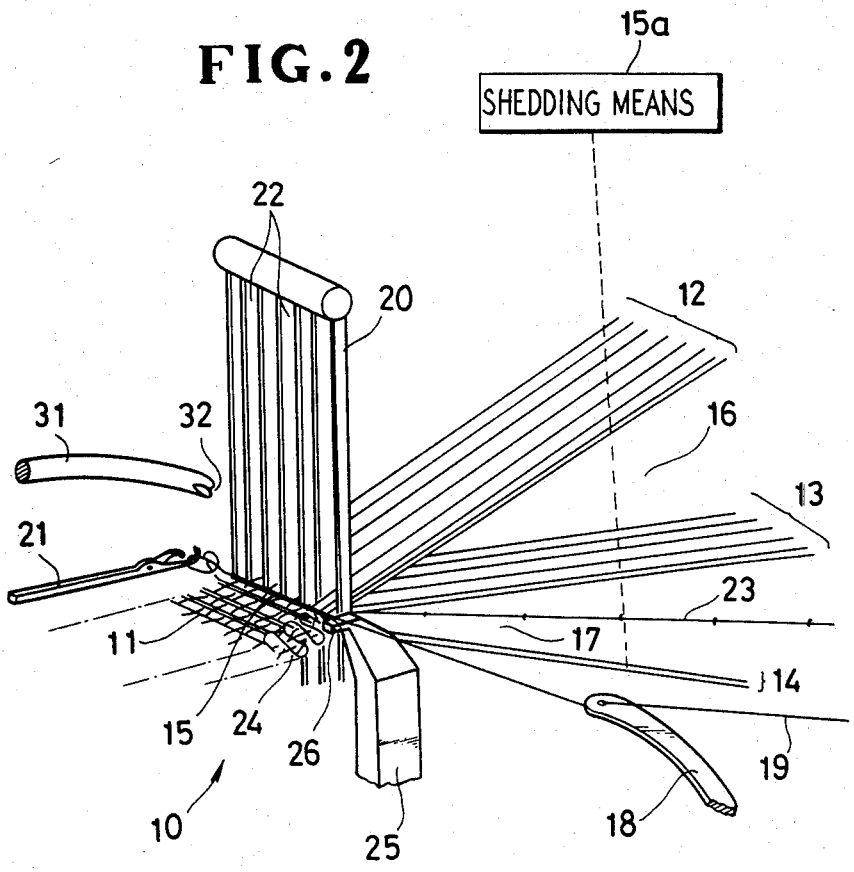

FIGS. 1 and 2 illustrate an apparatus for manufacturing a woven slide fastener stringer in accordance with the present invention. The apparatus comprises a loom 10 for progressively weaving a stringer tape 11 of warp threads 12, 13, 14 at a fell 15, the loom 10 including conventional heddles or a shedding means 15*a* shown diagrammatically for forming a pair of upper and lower warp sheds 16, 17 between the warp threads 12, 13, 14 and for selectively moving the warp threads 12, 13, 14 up and down, a filling carrier or weft inserter 18 disposed at one edge of the warp threads 12, 13, 14 and angularly movable for inserting a weft thread 19 in the upper warp shed 16 between the warp threads 12, 13, a reed 20 movable back and forth for beating the weft thread 19 inserted in the shed 16 against the fell 15, and a knitting needle 21 reciprocably disposed at the opposite edge of the warp threads 12, 13, 14 for successively knitting loops of the weft thread 19 projecting out the warp shed 16 to form a tape selvage. The reed 20 has a plurality of longitudinal slots 22 through which the warp threads 12, 13, 14 extend from the heddle 15*a* to the fell 15. An element-forming filamentary material of synthetic resin 23, which has a plurality of prospective coupling head portions 47 (FIGS. 5 and 6) formed in advance thereon at equal intervals, is introduced in the lower warp shed 17 through the second endmost slot 22*a* to the fell along a longitudinal path extending between and substantially parallel to the warp threads 12, 13, 14. The longitudinal slot 22*a* through which the filamentary material 23 passes is selected on the basis of the length L (FIG. 5) of a coupling element to be formed.

Figure 3:
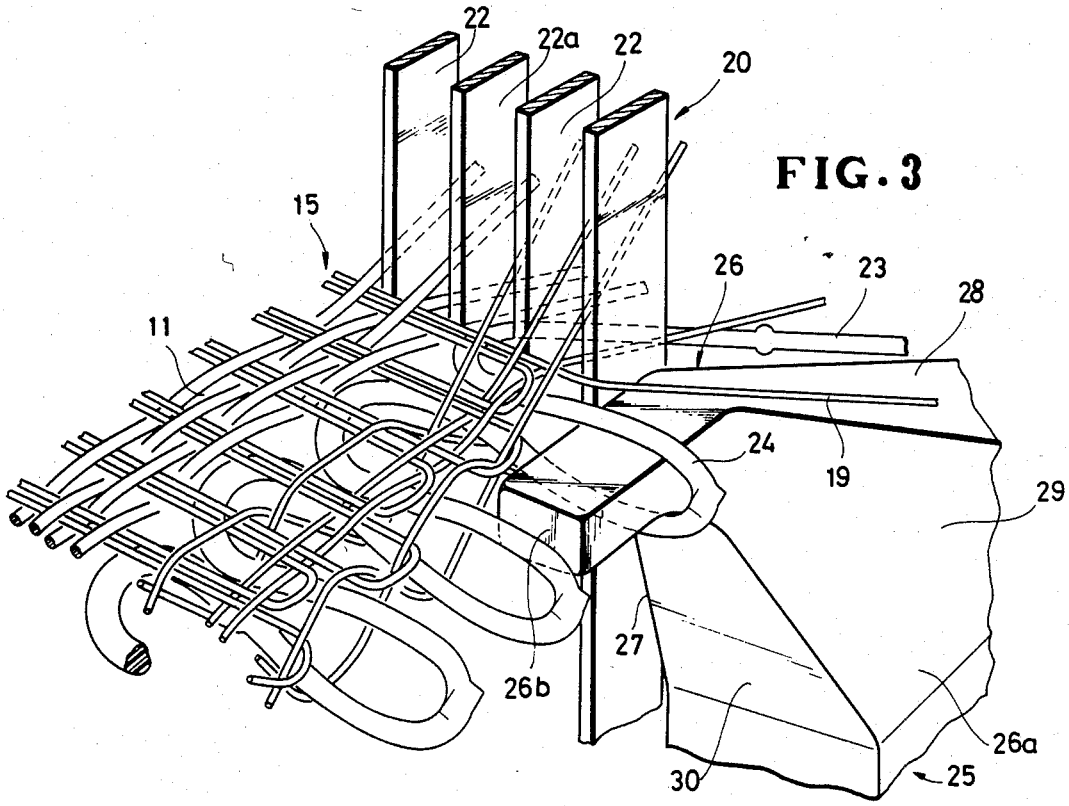
FIG. 3 is an enlarged perspective view of a portion of the apparatus shown in FIG. 2.

The apparatus also includes a coiling means operable in synchronism with the loom 10 for coiling the element-forming filamentary material 23 into a row of coupling elements 24 whereby the row of coupling elements 24 is woven integrally into the stringer tape 11 as the latter is woven. The coiling means comprises a rocker arm 25 disposed at the one edge of the warp threads 12, 13, 14 and rockingly movable about its one end. As shown in FIG. 3, the rocker arm 25 has at the opposite or distal end a hook 26 including a head portion 26*a* and a nose portion 26*b* projecting from the head portion 26*a* in a direction parallel to the warp threads 12, 13, 14 and hence to the path of the filamentary material 23. The nose portion 26*b* is in the form of a rectangular block and has a transverse cross section which defines a space between a pair of upper and lower legs of each coupling element 24. The head portion 26*a* has a shape like the frustum of a pyramid defined by four slanted surfaces 27, 28, 29, 30. The slanted surface 27–30 enable the filamentary material 23 to slide smoothly thereon and over the nose portion 26*b*. Upon rocking movement of the rocker arm 25, the hook 26 moves, in a plane substantially perpendicular to the general plane of the stringer tape 11, between a first position shown in FIGS. 2 and 3 in which it is located in alignment with the fell 15 and a second position shown in FIG. 1 in which it is located remotely from the fell 15.

Figure 5:
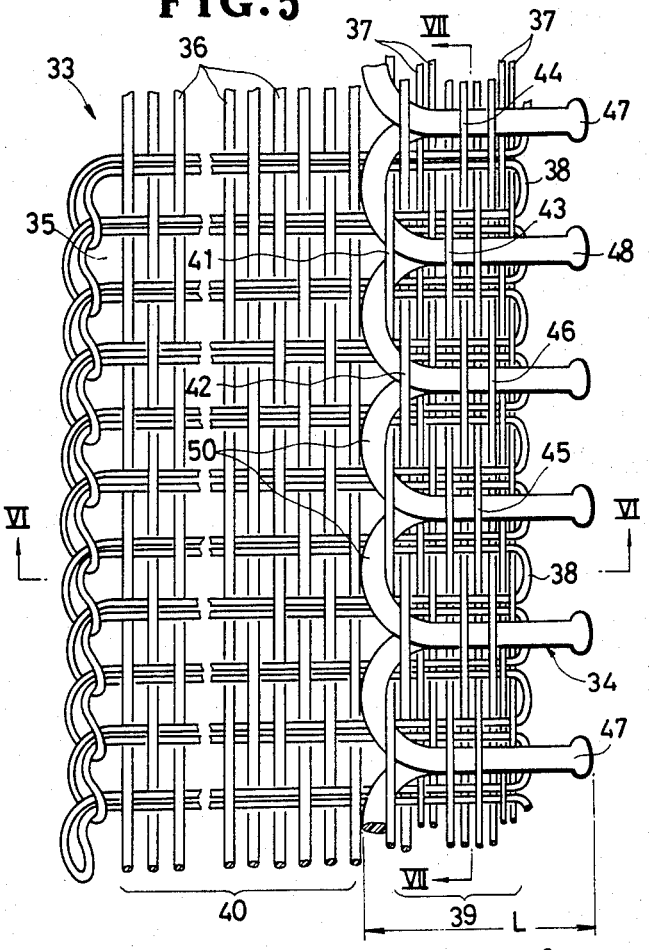
FIG. 5 is an enlarged schematic plan view of a woven slide fastener stringer according to the present invention.
Figure 6:
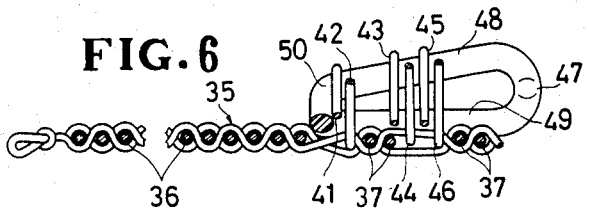
FIG. 6 is a transverse cross-sectional view taken along line VI—VI of FIG. 5.

The coiling means also includes an arcuate pusher arm 31 disposed at the opposite edge of the warp threads 12, 13, 14 and angularly movable across the lower warp shed 17. The pusher arm 31 has a bifurcated end portion 32 for receiving therein the element-forming filamentary material 23 having the equidistantly spaced prospective coupling head portions 47 (FIGS. 5 and 6). The pusher arm 31 is actuated in timed relation to the rocker arm 25 so that while the hook 26 is at its second position shown in FIG. 1, the bifurcated end portion 32 of the pusher arm 31 engages the element-forming filamentary material 23 and displaces it by pushing the same outside the warp threads 12, 13, 14 beyond the inclined surfaces 28, 29 of the hook's head portion 26*a*.

The apparatus operates as follows. For purpose of illustration, a cycle of the operation of the apparatus begins under the conditions shown in FIG. 1 in which (1) the element-forming filamentary material 23 is displaced by the pusher arm 31 outside the warp threads 12, 13, 14 beyond the hook 26 into hooked engagement therewith, (2) the weft thread 19 inserted by the filling carrier 18 through the upper warp shed 16 is ready for hooked engagement with the knitting needle 21, and (3) the reed 20 is retracted in a position away from the fell 15 of the stringer tape 11 being woven. Then, the rocker arm 25 is actuated to move angularly in the direction indicated by the arrow in FIG. 1 whereupon the hook 26 moves from the second position of FIG. 1 to the first position of FIGS. 2 and 3. At the same time, the reed 20 is actuated to move forward to beat the weft thread 19 just inserted against the fell 15. During that time, the element-forming filamentary material 23 is coiled around the hook's nose portion 26*b* substantially in parallel relation to the fell 15 to thereby form a coupling element 24.

Thereafter, while the rocker arm 25 and hence the hook 26 is at rest at the first position shown in FIGS. 2 and 3, the reed 20 is retracted away from the fell 15, then the heddle 15*a* is actuated to move the warp threads 12, 13, 14 up and down across the warp sheds 16, 17, and the filling carrier 18 is again actuated to insert the weft thread 19 in the upper warp shed 16. After the reed 20 has beat the weft thread 19 just inserted against the fell 15, the rocker arm 25 moves angularly away from the fell 15 to bring the hook 26 into the second position shown in FIG. 1. Simultaneously therewith, the reed 20 is moved back again to its retracted position. Finally, the heddle 15*a* is actuated to change the respective positions of the warp threads 12, 13, 14 into those shown in FIG. 1, to thereby complete a cycle of operation of the apparatus.

Figure 4:
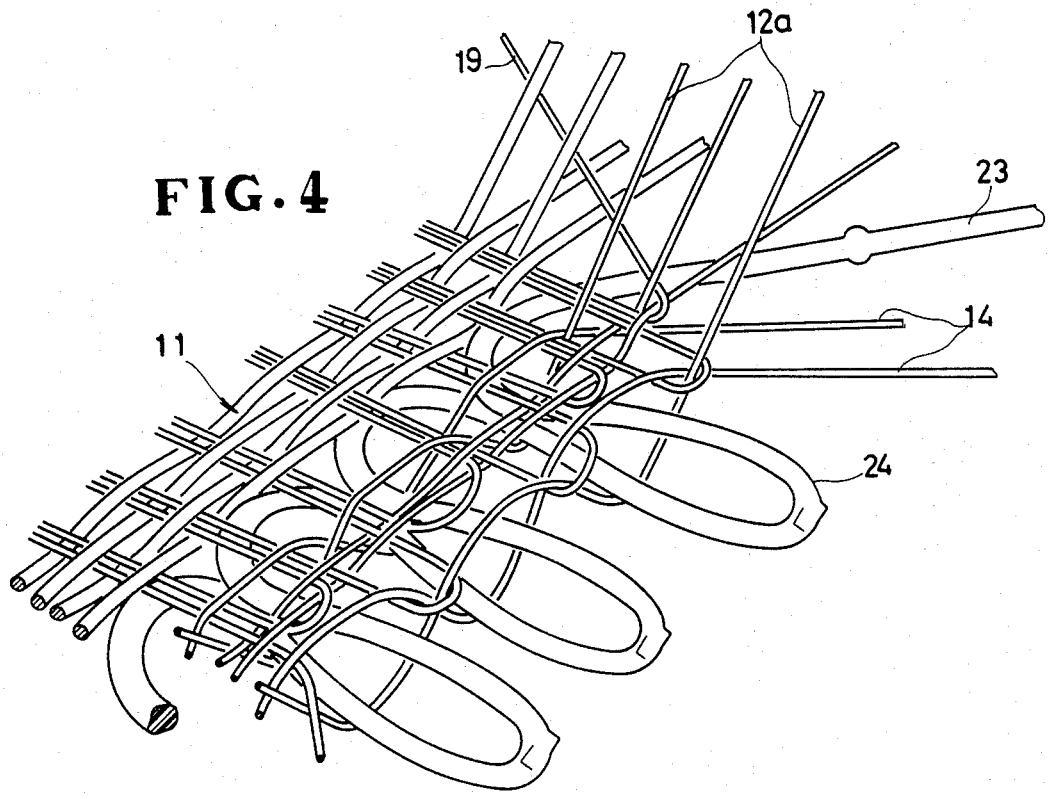
FIG. 4 is an enlarged perspective view of a portion of the slide fastener stringer as being produced, the parts not shown being in the position of FIG. 1.

FIG. 4 shows the structure of a woven slide fastener stringer being woven on the apparatus, the stringer having the row of coupling elements 24 woven integrally into the stringer tape 11. The row of coupling elements 24 is fixed to the stringer tape 11 along a longitudinal edge thereof by the binding warp threads 12*a*, 14 running respectively along undulated paths in symmetrical patterns in such a manner as to overlie one of the legs of the coupling elements 24 and to interlace with the weft thread 19 under the other of the legs of the coupling elements 24.

With the apparatus thus arranged, the warp threads 12, 13, 14 are protected from interfering with or otherwise being damaged by the hook 26 because the movement of the hook 26 is limited to take place only outside the warp threads 12, 13, 14, with the result that the apparatus can be operated at a higher speed and hence produces the woven slide fastener stringer at an increased rate of production.

Figure 7:
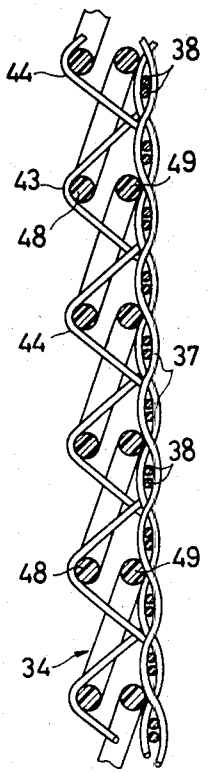
FIG. 7 is a longitudinal cross-sectional view taken along line VII—VII of FIG. 5.

FIGS. 5–7 show an example of woven slide fastener stringers 33 produced by the apparatus of the present invention. The slide fastener stringer 33 comprises a row of coiled coupling elements 34 formed of synthetic resin fixed to a slide fastener stringer tape 35 woven of foundation warp threads 36, 37 and a single foundation weft thread 38, the row of coupling elements 34 extending along a longitudinal edge portion 39 of the stringer tape 35. The foundation warp threads 36 and the foundation weft thread 38 jointly constitute a web portion 40 of the stringer tape 35, and the foundation warp threads 37 and the foundation weft thread 38 jointly constitute the longitudinal edge portion 39 of the stringer tape 35. The warp threads 36 are thicker than the warp threads 37. The row of coupling elements 34 is secured to the stringer tape 35 by means of a binding thread system including a pair of first binding warp threads 41, 42 and a plurality of second binding warp threads 43, 44, 45, 46.

Each of the coupling elements 34 comprises a coupling head 47 projecting transversely beyond the longitudinal edge portion 39 of the stringer tape 35, and a pair of upper and lower legs 48, 49 (FIGS. 6 and 7) extending from the coupling head 47 in a common direction and spaced from each other vertically in a direction substantially perpendicular to the general plane of the stringer tape 35. The upper and lower legs 48, 49 are blended into and interconnected by a heel portion 50 located remotely from the coupling head 47. The lower legs 49 of the coupling elements 34 are mounted on the longitudinal edge portion 39 of the stringer tape 35. The foundation weft thread 38 is inserted in double picks between adjacent coupling elements 34 so that there is a pair of picks of the foundation weft thread 38, one on each side of each of the lower legs 49 of the coupling elements 34 as shown in FIGS. 5 and 7.

The first binding warp threads 41, 42 of the binding thread system are disposed on the heel portions 50 of the coupling elements 34 and are interlaced with every other one of the pairs of picks of the foundation weft thread 38 in symmetrical relation substantially with respect to the general plane of the stringer tape 35. Likewise, the second binding warp threads 43–46 are disposed on the upper legs 48 of the coupling elements 34 and are interlaced with every other one of the pairs of picks of the foundation weft thread 38. The warp threads 43–46 run along undulated paths in staggered relation to one another between a pair of groups of the foundation warp threads 37 spaced laterally from each other. The first binding warp threads 41, 42 are preferably made of elastic yarns for neatly binding the coupling elements 34 and are thicker than the warp and weft threads 43–46, 37 in the longitudinal edge portion 39 of the stringer tape 35.

With the arrangement described above, the binding warp threads 41, 42, 43–46 secure the row of coupling elements 34 to the longitudinal edge portion 39 of the stringer tape 35 in substantially the same manner as rows of sewing stitches, and there is no weft thread extending between the upper and lower legs 48, 49 of the coupling elements 34 in the space between adjacent coupling elements 34. The coupling elements 34 thus secured have a certain degree of flexibility which is enough to follow the movement of the slide fastener stringer 33, and provide a sufficient degree of coupling strength which enables opposite rows of coupling elements to mesh with each other firmly against the danger of becoming accidentally separated. Furthermore, the weft thread 38 inserted in double picks makes the longitudinal edge portion 39 compact and resilient in structure, and the coupling elements 34 are secured to such longitudinal edge portion 39 with the lower legs 49 received between respective pairs of picks of the weft thread 38 and the upper legs 48 biased by the binding warp threads 43–46 toward the lower legs 49. With this arrangement, the coupling elements 34 are strong enough to withstand not only torsional stress but also external forces applied thereto in a direction perpendicular to the general plane of the stringer tape 35.

Figure 8:
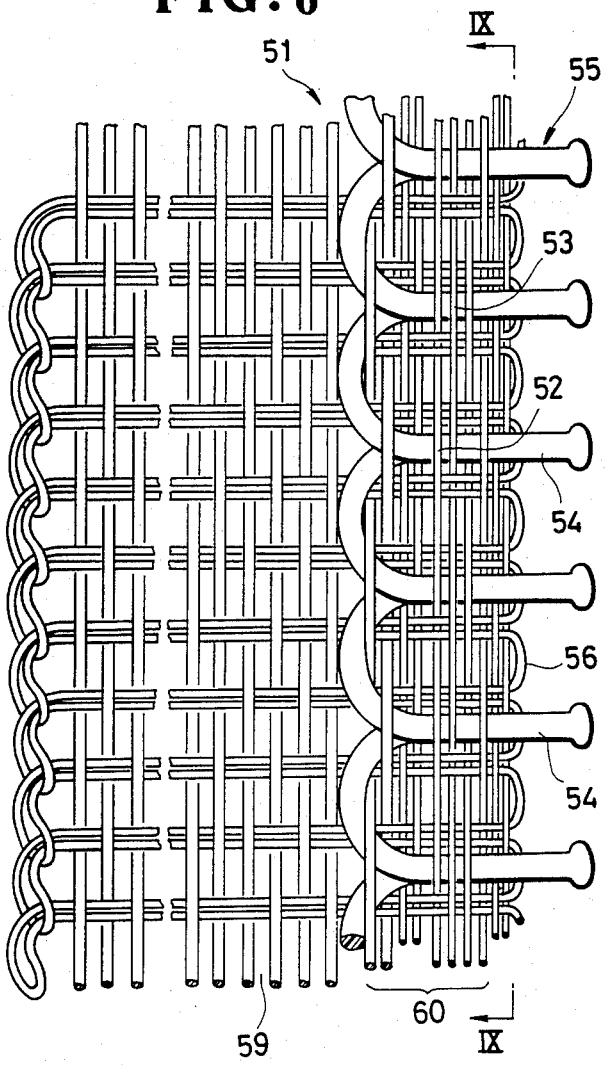
FIG. 8 is a view similar to FIG. 5 of another embodiment of the present invention.
Figure 9:
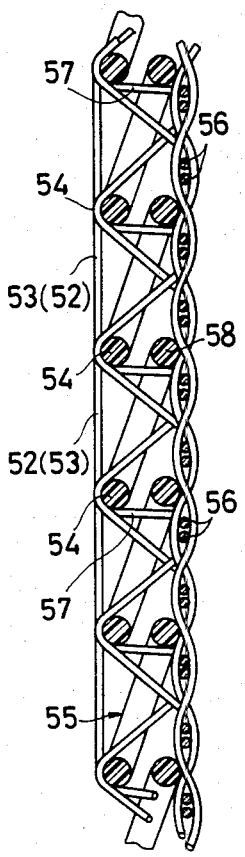
FIG. 9 is a longitudinal cross-sectional view taken along line IX—IX of FIG. 8.

Another woven slide fastener stringer 51 produced on the apparatus of the invention is shown in FIGS. 8 and 9. The woven slide fastener stringer 51 is substantially the same as the stringer 33 of the foregoing embodiment with the exception that two out of four second binding warp threads 52, 53 extend transversely across adjacent pairs of upper legs 54 of a row of coupling elements 55 and are interlaced with one pick of every other one of pairs of picks of a foundation weft thread 56. Each of the binding warp threads 52, 53 has portions 57 extending between the upper legs and corresponding lower legs 58 of the coupling elements 55 substantially normal to the general plane of the woven stringer tape 59 of the stringer 51. With the binding warp threads 52, 53 having the portions 57, the coupling elements 54 can be secured more positively to a longitudinal edge portion 60 of the stringer tape.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A method of manufacturing a woven slide fastener stringer, comprising the steps of:

(a) weaving a stringer tape of warp threads and a single weft thread progressively at a fell; and (b) coiling an element-forming filamentary material, supplied to said fell longitudinally along a path extending between and substantially parallel to said warp threads, into a row of coupling elements as they are woven into said stringer tape in synchronism with the weaving of said stringer tape, said coiling step including (1) displacing by pushing said element-forming filamentary material out of said path into a position outside said warp threads, remote from the fell to enable it to become hooked and the pushing terminates, (2) hooking said element-forming filamentary material at said position to form a coupling element, and (3) moving said coupling element from said position to another position located outside said warp threads in alignment with said fell.

2. An apparatus for manufacturing a woven slide fastener stringer, comprising:

(a) a loom for weaving a stringer tape of warp threads and a single weft thread progressively at a fell, said loom including a reed having guide slots for the passage therethrough (1) of the warp threads and (2) of an element-forming filamentary material along a path extending between and substantially parallel to the warp threads, and a filling carrier disposed at one edge of the warp threads and reciprocable for introducing the weft thread into interlaced engagement with the warp threads; and (b) means operable in synchronism with said loom for coiling the element-forming filamentary material into a row of coupling elements, whereby the row of coupling elements are woven into the stringer tape as the latter is woven, said coupling means including (1) a hook disposed at said one edge of the warp threads and angularly movable, about an axis parallel to the general plane of the stringer tape, and in a plane perpendicular to the general plane of the stringer tape being woven, between a first position located in alignment with the fell and a second position remote from the fell, and (2) means disposed at the opposite edge of the warp threads for displacing the element-forming filamentary material out of said path beyond the warp threads beyond the plane of movement of said hook while said hook is at said second position.

3. An apparatus according to claim 2, said hook being integral with a rocker arm disposed at said one side of the warp threads and rockingly movable about said axis in a plane perpendicular to the general plane of the stringer tape being woven for enabling said hook to move between said first and second positions.

4. An apparatus for manufacturing a woven slide fastener stringer, comprising:

(a) a loom for weaving a stringer tape of warp threads and a single weft thread progressively at a fell, said loom including a reed having guide slots for the passage therethrough (1) of the warp threads and (2) of an element-forming filamentary material along a path extending between and substantially parallel to the warp threads, and a filling carrier disposed at one edge of the warp threads and reciprocable for introducing the weft thread into interlaced engagement with the warp threads; and (b) means operable in synchronism with said loom for coiling the element-forming filamentary material into a row of coupling elements, whereby the row of coupling elements are woven into the stringer tape as the latter is woven, said coiling means including (1) a hook disposed at said one edge of the warp threads and movable in a plane perpendicular to the general plane of the stringer tape being woven between a first position located in alignment with the fell and a second position remote from the fell, said hook including a head portion and a nose portion projecting from said head portion in a direction normal to the fell, the element-forming filamentary material being coiled around said nose portion when said hook is at said first position, and (2) means disposed at the opposite edge of the warp threads for displacing the element-forming filamentary material out of said path beyond the warp threads beyond said plane of the movement of said hook while said hook is at said second position.

5. An apparatus according to claim 4, said head portion being in the shape of a frustum of a pyramid defined jointly by four slanted surfaces.

6. An apparatus for manufacturing a woven slide fastener stringer, comprising:

(a) a loom for weaving a striper tape of warp threads and a single weft thread progressively at a fell, said loom including a reed having guide slots for the passage therethrough (1) of the warp threads and (2) of an element-forming filamentary material along a path extending between and substantially parallel to the warp threads, and a filling carrier disposed at one edge of the warp threads and reciprocable for introducing the weft thread into interlaced engagement with the warp threads; and (b) means operable in synchronism with said loom for coiling the element-forming filamentary material into a row of coupling elements, whereby the row of coupling elements are woven into the stringer tape as the later is woven, said coiling means including (1) a hook disposed at said one edge of the warp threads and movable in a plane perpendicular to the general plane of the stringer tape being woven between a first position located in alignment with the fell and a second position remote from the fell, and (2) means disposed at the opposite edge of the warp threads for displacing the element-forming filamentary material out of said path beyond the warp threads beyond said plane of the movement of said hook while said hook is at said second position, said displacing means comprising an angularly, reciprocably movable arcuate pusher arm having a portion engageable with the element-forming filamentary material.

7. An apparatus according to claim 6, said portion being a bifurcated distal end of said arcuate pusher arm.

8. An apparatus for manufacturing a woven slide fastener stringer, comprising:

(a) a loom for weaving a stringer tape of warp threads and a single weft thread progressively at a fell, said loom including a reed having guide slots for the passage therethrough (1) of the warp threads and (2) of an element-forming filamentary material along a path extending between and substantially parallel to the warp threads, a filling carrier disposed at one edge of the warp threads and reciprocable for introducing the weft thread into interlaced engagement with the warp threads, and heddle means dividing the warp threads into three superimposed groups of warp threads selectively movable up and down to jointly define therebetween a pair of first and second warp sheds, said filling carrier being reciprocable across said first warp shed for inserting the weft thread thereinto, the element-forming filamentary material being introduced in said second warp shed along said path; and (b) means operable in synchronism with said loom for coiling the element-forming filamentary material into a row of coupling elements, whereby the row of coupling elements are woven into the stringer tape as the latter is woven, said coiling means including (1) a hook disposed at said one edge of the warp threads and movable in a plane perpendicular to the general plane of the stringer tape being woven between a first position located in alignment with the fell and a second position remote from the fell, and (2) means disposed at the opposite edge of the warp threads for displacing the element-forming filamentary material out of said path beyond the warp threads beyond said plane of the movement of said hook while said hook is at said second position, said displacing means comprising an arcuate pusher arm angularly reciprocably movable across said second warp shed and having a portion engageable with the element-forming filamentary material.

* * * * *